US010199752B2

(12) United States Patent
Willems et al.

(10) Patent No.: US 10,199,752 B2
(45) Date of Patent: Feb. 5, 2019

(54) PATCHBOARD

(71) Applicant: Phoenix Contact GmbH & Co. KG, Blomberg (DE)

(72) Inventors: Marcel Willems, Blomberg (DE); Jürgen Brand, Detmold (DE); Ralph Hoppmann, Bad Oeynhausen (DE); Christian Kloppenburg, Büren Wewelsburg (DE); Kevin Berghahn, Blomberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/565,514

(22) PCT Filed: Apr. 8, 2016

(86) PCT No.: PCT/EP2016/057713
§ 371 (c)(1),
(2) Date: Oct. 10, 2017

(87) PCT Pub. No.: WO2016/162463
PCT Pub. Date: Oct. 13, 2016

(65) Prior Publication Data

US 2018/0076539 A1 Mar. 15, 2018

(30) Foreign Application Priority Data

Apr. 10, 2015 (DE) ..... 10 2015 105 545

(51) Int. Cl.
*H01R 4/48* (2006.01)
*H01R 9/24* (2006.01)

(52) U.S. Cl.
CPC ..... *H01R 9/2408* (2013.01); *H01R 9/2416* (2013.01); *H01R 9/2491* (2013.01); *H01R 4/48* (2013.01)

(58) Field of Classification Search
CPC .. H01R 9/2408; H01R 13/514; H01R 9/2416; H01R 9/2491; H01R 4/48
(Continued)

(56) References Cited

U.S. PATENT DOCUMENTS 4,425,018 A 1/1984 Stenz
4,611,879 A 9/1986 Bullard
(Continued)

FOREIGN PATENT DOCUMENTS

DE 195 12 226 A1 10/1996
DE 10 2013 101 830 A1 7/2014
(Continued)

*Primary Examiner* — Gary F Paumen
(74) *Attorney, Agent, or Firm* — David S. Safran; Roberts Mlotkowski Safran Cole & Calderon, P.C.

(57) ABSTRACT

A patchboard includes a plurality of honeycomb components which each have a box-shaped housing having two faces and four side surfaces. The two faces each have a connection region. At least two of the side surfaces have a latching element for connecting to another honeycomb component, and at least two of the honeycomb components have different cross-sections. The width and/or height of a honeycomb component having a larger cross-section is a multiple of the width and/or height of a honeycomb component having a smaller cross-section. The number of latching elements of a side surface having a greater width or greater height of a honeycomb component having a larger cross-section is a corresponding multiple of the number of latching elements of a side surface having a smaller width or smaller height of a honeycomb component having a smaller cross-section.

9 Claims, 9 Drawing Sheets

(58) Field of Classification Search
USPC ..... 439/717, 715
See application file for complete search history.

(56) References Cited

U.S. PATENT DOCUMENTS

| | | | | |
|---|---|---|---|---|
| 5,288,251 | A * | 2/1994 | Sumida | H01R 13/514 439/701 |
| 5,295,870 | A | 3/1994 | Rei et al. | |
| 6,059,615 | A | 5/2000 | Pendleton et al. | |
| 6,196,882 | B1 * | 3/2001 | Sato | H01R 9/2408 174/50 |
| 2004/0082214 | A1 * | 4/2004 | Lafragette | H01R 9/2408 439/342 |
| 2013/0082048 | A1 * | 4/2013 | Hirasawa | H01R 13/73 220/3.9 |

FOREIGN PATENT DOCUMENTS

| | | |
|---|---|---|
| DE | 10 2014 101 528 A1 | 8/2015 |
| EP | 1 091 380 A1 | 4/2001 |

* cited by examiner

PATCHBOARD

BACKGROUND OF THE INVENTION

Field of the Invention

The invention relates to a patchboard with multiple honeycomb components, whereby the individual honeycomb components in each case have a box-shaped housing with two front surfaces and four side surfaces, which extend between the front surfaces, and whereby the two front surfaces of the honeycomb components in each case have at least one connecting area.

Description of Related Art

Patchboards are used in particular in places where a number of electrical conductors must be connected in a very tight space. To this end, patchboards are known from experience in which within a solid, rectangular assembly frame, a number of honeycomb components are arranged in corresponding chambers of the frame. Electrical conductors can be connected to the patchboard or the individual honeycomb components both from the front, or field side, and from the rear, or plant side. To this end, connecting elements are arranged in the box-shaped housings of the individual honeycomb components, which elements are in general connected to one another via corresponding busbars, so that an electrical conductor that is inserted through a corresponding conductor inflow opening in the forward front surface can be electrically connected to an electrical conductor or to a connecting contact that is inserted through a corresponding inflow opening in the rear front surface of the housing.

Such a patchboard having a number of honeycomb components is known from, for example, German Patent Application DE 195 12 226 A1. In the patchboard that is disclosed in this publication, the individual honeycomb components, which are inserted into the individual chambers of the assembly frame, all have the same dimensions and the same number and size of conductor inflow openings, so that both the maximum conductor cross-section of the connectable conductor and the number thereof are preset. Adapting the patchboard to a user's individual needs is not possible in the case of this known patchboard. If the number of conductors to be connected has to be increased, a correspondingly larger patchboard having a larger number of individual honeycomb components thus has to be used, whereby in practice, patchboards with 18, 32, 48, 54 or 80 honeycomb components are available.

A patchboard, as it is used in, for example, rolling stock for electrical distribution, is known from Gelman Patent Application DE 10 2013 101 830 A1. Depicted in FIGS. 7 and 8 of this publication are two different assembly frames or distributor housings, in which in each case, a preset number —18 or 54—of chambers is laid out in matrix form, in which in each case a honeycomb component with two conductor inflow openings in the forward front surface is arranged. In fact, in this known patchboard, the production of the individual honeycomb components is to be simplified, but flexible adaptation of the patchboard to a user's individual needs is also not possible here.

SUMMARY OF THE INVENTION

The object of this invention is therefore to make available a patchboard with multiple honeycomb components, which are distinguished by an increased flexibility and better adaptability to a user's individual needs.

This object is achieved in the above-described patchboard with the features that at least two side surfaces of the honeycomb components in each case have at least one latching element for connecting to another honeycomb component, in that at least two honeycomb components of the patchboard have different cross-sections, whereby the width and/or the height of a honeycomb component having a larger cross-section is a whole multiple of the width and/or height of a honeycomb component having a smaller cross-section. In this case, the number of latching elements of a side surface having a greater width or a greater height of a honeycomb component having a larger cross-section is a corresponding whole multiple of the number of latching elements of a side surface having a smaller width or smaller height of a honeycomb component having a smaller cross-section.

The patchboard according to this invention first has a greater flexibility, so that the individual honeycomb components can be directly connected to one another, so that they have in each case at least one latching element on at least two side surfaces, and so that the use of a rigid assembly frame that sets the number of individual honeycomb components can be eliminated. As a result, the patchboard can have any number of honeycomb components, so that the size and, in particular, the number of poles of the patchboard can be adapted to the respective requirement and if necessary can also be easily changed. Such a patchboard or correspondingly designed honeycomb components are known from German Patent Application DE 10 2014 101 528 A1 that was post-published.

In the case of the patchboard according to the invention, the flexibility relative to the connectability of different conductors having different conductor cross-sections is increased so that the individual honeycomb components of the patchboard have at least partially different dimensions, in particular different cross-sections. Thus, the possibility is created that honeycomb components are also arranged within a patchboard, to which conductors having larger cross-sections or connecting plugs having larger dimensions can be connected. So that individual honeycomb components have a larger cross-section, i.e., a greater width and/or a greater height, the possibility exists that these honeycomb components also have correspondingly larger connecting areas with correspondingly larger conductor inflow openings or larger plug openings and larger connecting contacts.

So that honeycomb components having different cross-sections can be connected to one another to form a patchboard, the width and/or the height of a honeycomb component having a larger cross-section is a whole multiple of the width and/or the height of a honeycomb component having a smaller cross-section. The patchboard according to the invention can have, for example, a number of honeycomb components, which all have the same height and the same depth, whereby, however, some honeycomb components have a double width in comparison to the other honeycomb components. The honeycomb components of a patchboard can also just as well differ from one another only in height or both in height and in width.

The latching of the individual honeycomb components with one another is in this case ensured in that the number of latching elements on a side surface having a greater width or greater height of a honeycomb component having a larger cross-section is a corresponding whole multiple of the number of latching elements of a side surface having a smaller width or smaller height of a honeycomb component having a smaller cross-section. In the case of a double-wide honeycomb component in comparison to a honeycomb component having the smallest cross-section, in each case a double number of latching elements—in comparison to the number of latching elements in the case of the honeycomb component having the smallest cross-section—is thus also provided on the side surfaces of the housing that determine the width. A multiplication of the width or the height of a honeycomb component thus always is accompanied by a corresponding multiplication of the number of latching elements on the corresponding side surfaces of the honeycomb component. This means that, for example, a honeycomb component with a double width 2×W can be connected to two honeycomb components, which in each case have only the half-width W.

In the case of the patchboard according to the invention, honeycomb components having different cross-sections can have a different number of connecting areas and/or connecting areas of different sizes. Thus, a patchboard, for example, can have multiple honeycomb components, to which in each case three electrical conductors having a conductor cross-section of a maximum of 1.5 $mm^2$ can be connected. Moreover, the patchboard can also have honeycomb components, to which in each case two electrical conductors having a maximum conductor cross-section of 2.5 $mm^2$ can be connected. In addition, the patchboard can also have honeycomb components that are designed for connection to one or two conductors having a maximum conductor cross-section of 4 $mm^2$. In this case, these honeycomb components have, for example, a width that is twice as large as the honeycomb components to which three conductors having a maximum cross-section of 1.5 $mm^2$ can be connected. By an additional doubling of the height of a honeycomb component, for example, the number of connectable conductors can then also be doubled or the maximum conductor cross-section of the conductors, which can be connected to the honeycomb component, can be further increased.

Preferably, on all four side surfaces of the honeycomb components, at least one latching element for connecting to another honeycomb component is provided. In this case, the latching elements, which are designed on side surfaces that are opposite to one another, are designed corresponding to one another, so that a honeycomb component can be connected to another honeycomb component both in the x-direction and in the z-direction. The latching elements that correspond to one another in this case can be designed as, for example, latching pins and latching openings, as arms and grooves, in particular as dovetail-shaped arms and corresponding dovetail-shaped grooves or as latching catches and latching projections.

A patchboard according to the invention having a number of honeycomb components can thus have multiple honeycomb components having the dimensions H×W×D, whereby these honeycomb components represent a type of basic component. In addition, the patchboard can also have, for example, honeycomb components having the cross-sections H×2W or 2H×W. Moreover, honeycomb components having the cross-sections 2H×2W, H×3W, 2H×3W, 3H×W, 3H×2W, 3H×3W . . . can also be part of the patchboard. It can be seen from this that the patchboard according to the invention can consist of a number of honeycomb components, whereby multiple honeycomb components can have different dimensions, in particular different cross-sections. In this case, the cross-sections of the individual honeycomb components are W×H or a whole multiple of W×H.

According to an advantageous configuration, the patchboard according to the invention has, moreover, at least two honeycomb components, which have a different depth. The depths of the individual honeycomb components are in this case—unlike the height and the width—freely selectable, so that the depth of a larger or longer honeycomb component does not have to be a multiple of the depth of a smaller or shorter honeycomb component.

Thus, in the case of a patchboard, which has honeycomb components having different depths, the latching of the individual honeycomb components with one another is ensured; the respective latching elements of the individual honeycomb components must be arranged corresponding to one another. According to a preferred configuration of the patchboard according to the invention, the distance from the latching elements of the respective side surface to the first front surface in the case of a honeycomb component having a smaller depth corresponds to the distance from the latching elements of the corresponding side surface to the first front surface in the case of a honeycomb component having a greater depth. The latching elements of a certain side surface thus all are at the same distance from the first front surface, regardless of at what depth the respective honeycomb component is. This means that the first front surfaces of the individual honeycomb components of a patchboard lie in a plane even when individual honeycomb components have different depths.

In the case of an alternative embodiment of the patchboard according to the invention, the latching elements of a side surface are arranged in a symmetrical manner to the longitudinal extension of a respective honeycomb component, so that when connected together, the two front surfaces of a honeycomb component having a smaller depth in the longitudinal direction are the same distance from the front surfaces of an adjoining honeycomb component having a greater depth. In the case of such a patchboard, which has honeycomb components having different depths, neither the first front surfaces nor the second front surfaces of the individual honeycomb components thus all lie in one plane.

According to a final advantageous configuration of the patchboard according to the invention, which is still to be briefly explained here, multiple terminal elements are arranged on at least one side of the patchboard, which elements are connected to the adjacent honeycomb components via corresponding latching elements. The terminal elements thus have latching elements on the side surface facing the honeycomb components, which elements correspond to the latching elements of the honeycomb components that are provided on the opposite side surface. If the honeycomb components on the corresponding side surface have, for example, dovetail-shaped arms, corresponding dovetail-shaped grooves are made in the opposite side surface of the terminal elements.

The terminal elements can in this case have, for example, a marking area, which can be used to identify a part of the patchboard or else the entire patchboard. The marking area can have a groove, in which a corresponding marking sign can be engaged. In addition, the marking area, however, can also be designed so that the latter can itself be immediately labeled. As an alternative or in addition, individual terminal elements can also be designed so that they are used for fastening the patchboard to, for example, a switch cabinet wall or in a recess of a switch cabinet wall. To this end, a terminal element can have, for example, a fastening flange having an opening for passing a fastening element, for example a screw. As an alternative to this, a terminal element that is used for fastening can also be designed so that it has a latching area by means of which the patchboard can be fastened to a support rail.

More specifically, there are now a considerable number of possibilities to configure and to further develop the patchboard according to the invention and the individual honeycomb components, from which the patchboard is built up. To this end, reference is made both to the claims following claim 1 and the subsequent description of preferred embodiments in connection with the drawings. In the drawings,

DETAILED DESCRIPTION OF THE INVENTION

Figure 1:
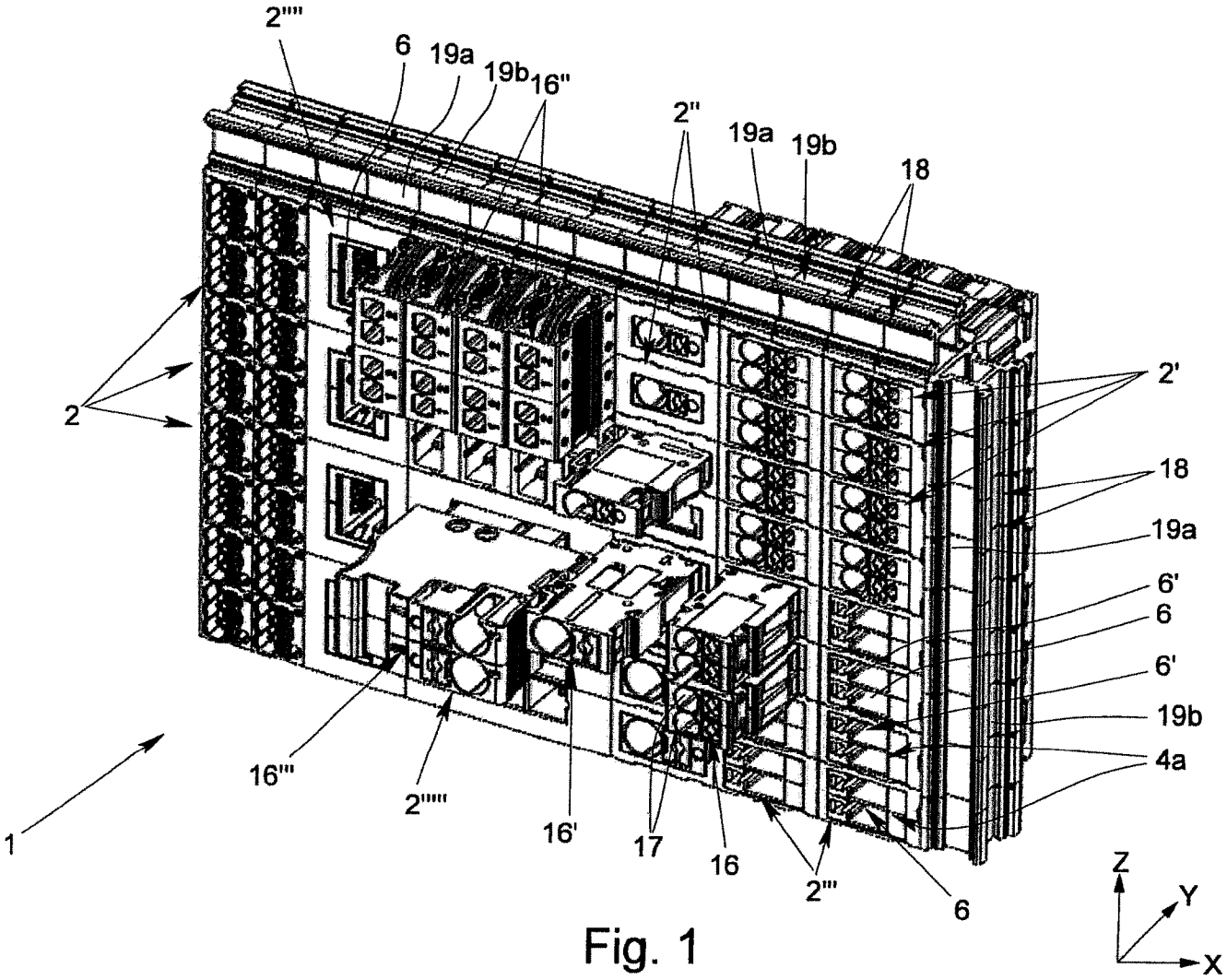
FIG. 1 shows an embodiment of a patchboard that is built up from a number of honeycomb components.

FIG. 1 shows an embodiment of a patchboard 1 according to the invention, which has a number of different honeycomb components 2, 2', 2", 2''', 2'''', and 2''''', whereby the individual honeycomb components are connected to one another directly. The patchboard 1 thus does not have any solid assembly frames, into whose individual chambers the individual honeycomb components 2 are inserted, so that the number of individual honeycomb components 2, and thus also the dimensions of the patchboard 1 can be flexibly adapted to the respective requirements of a user and if necessary can also be easily changed. The embodiment of the patchboard 1 that is depicted in FIG. 1 has a rectangular base surface, which follows from the arrangement of the individual honeycomb components 2, 2', 2", 2''', 2'''', 2''''' with respect to one another.

Figure 2:
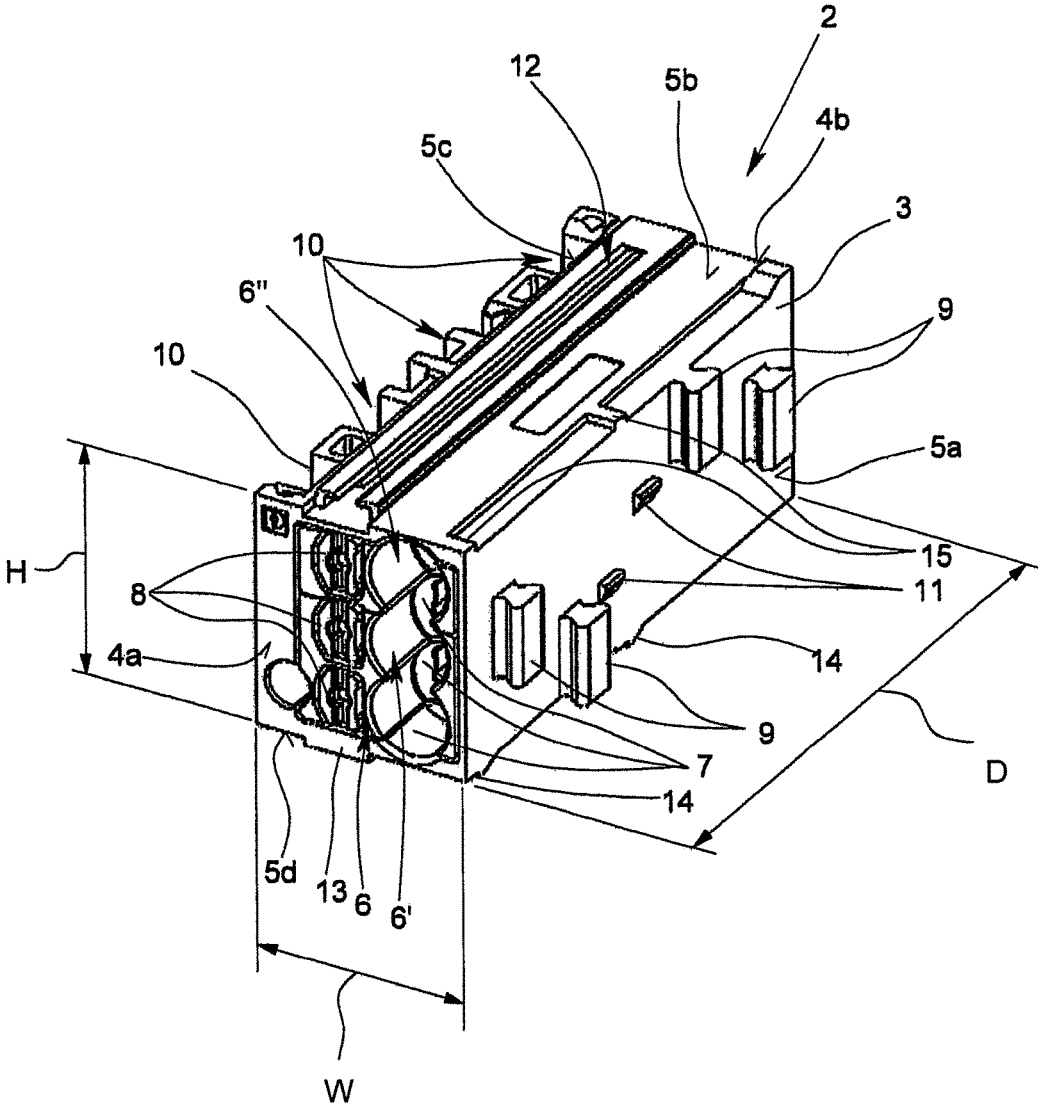
FIG. 2 shows a first embodiment of an individual honeycomb component.

FIG. 2 shows a first embodiment of an individual honeycomb component 2, which has a box-shaped housing 3 with two front surfaces 4*a*, 4*b* and four side surfaces 5*a*, 5*b*, 5*c*, and 5*d*. The individual side surfaces 5*a*, 5*b*, 5*c*, 5*d* in each case extend between the two front surfaces 4*a*, 4*b* and are in each case arranged at an angle of 90° to the front surfaces 4*a*, 4*b*. The honeycomb component 2 or the housing 3 of the honeycomb component 2 thus has a rectangular cross-section, having a width W and a height H. Moreover, the honeycomb component 2 has a length or depth D. In the depicted honeycomb component 2, the dimensions W×H×D are, for example 12 mm×11 mm×30 mm, noting that these dimensions are by no means limiting.

The honeycomb component 2 that is depicted in FIG. 2 with the dimensions H×W×D represents a type of "basic component" of the patchboard 1. All other honeycomb components 2 of the patchboard 1 have either the same dimensions, in particular the same cross-section as the honeycomb component 2, or larger dimensions, in particular a larger cross-section than the honeycomb component 2, which will be explained more precisely below.

On the forward front surface 4*a* of the honeycomb component 2, three connecting areas 6, 6', 6", which are preferably designed as spring-force clamping connections, are provided. Each connecting area 6, 6', 6" has a conductor inflow opening 7 and an actuating element 8 that is designed as a printer. Within the housing 3, three clamping springs are arranged, whereby by means of the clamping springs, a conductor, stripped of insulation, that is inserted through the respective conductor inflow opening 7, can be clamped against a busbar, also arranged in the housing 3, and thus can be connected in an electrically conductive manner to the busbar. The rear front surface 4*b* can also have three connecting areas. In addition, it is also possible, however, that the two front surfaces 4*a*, 4*b* have a different number of connecting areas; the rear front surface 4*b*, for example, has only two connecting areas.

To connect the honeycomb component 2 to other honeycomb components, the honeycomb component 2 that is depicted in FIG. 2 has at least one latching element on all four side surfaces 5*a*, 5*b*, 5*c*, 5*d*. As a result, the honeycomb component 2 can be connected on all four of its side surfaces 5*a*, 5*b*, 5*c*, 5*d*, and thus both in the x-direction and in the z-direction, to another honeycomb component 2, in order to form a patchboard 1, as it is depicted in, for example, FIG. 1.

In the embodiment of the honeycomb component 2 that is depicted in FIG. 2, four arms 9, which in each case have a dovetail-shaped cross-section and are arranged at different positions, both in the x-direction and in the z-direction on the side surface 5*a*, are provided on the first side surface 5*a*. In the depicted embodiment, the individual arms 9 in each case have a longitudinal extension in the z-direction, which corresponds to approximately ⅓ the height H of the housing 3 or the honeycomb component 2. On the side surface 5*c* of the honeycomb component 2 that is opposite to the side surface 5*a*, grooves 10 corresponding to the arms 9 are made, which also have a dovetail-shaped cross-section, so that two honeycomb components 2 can be arranged beside one another in the x-direction. Moreover, forward on the first side surface 5*a* are another two latching catches 11, which interact with corresponding—here, not visible—latching projections on the side surface 5*c*.

The upper side surface 5*b* has a groove 12 that extends approximately over the entire depth D of the honeycomb component 2. Corresponding to the groove 12, an arm 13 is made on the lower side surface 5*d* of the honeycomb component 2, so that two honeycomb components 2 can be arranged in the z-direction one above the other by the arm 13 on the lower side surface 5*d* of an upper honeycomb component 2 being inserted into the groove 12 on the upper side surface 5*b* of a lower honeycomb component 2. In addition, two latching catches 14 are also made on the lower side surface 5*d* of the housing 3, which catches interact with two latching projections 15 made on the upper side surface 5*b*, and thus prevent an accidental loosening of two honeycomb components 2 that are connected to one another.

Figure 3:
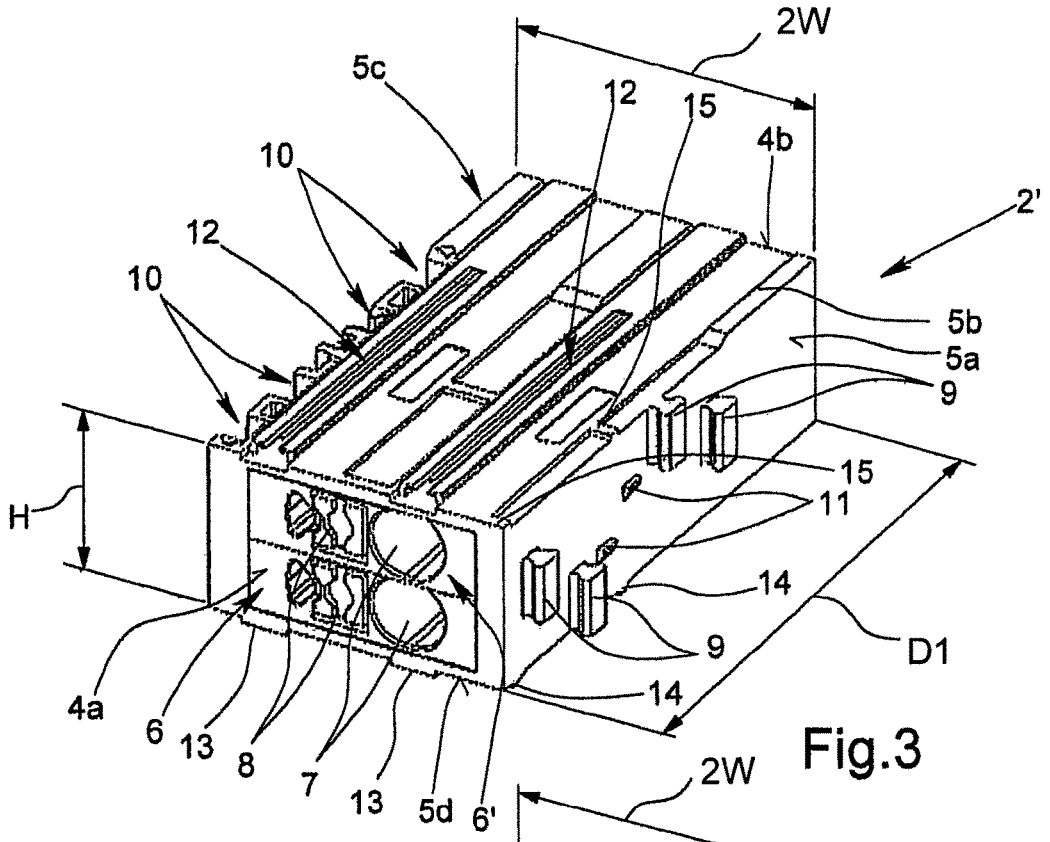
FIG. 3 shows an embodiment of an individual honeycomb component with a larger cross-section.
Figure 4:
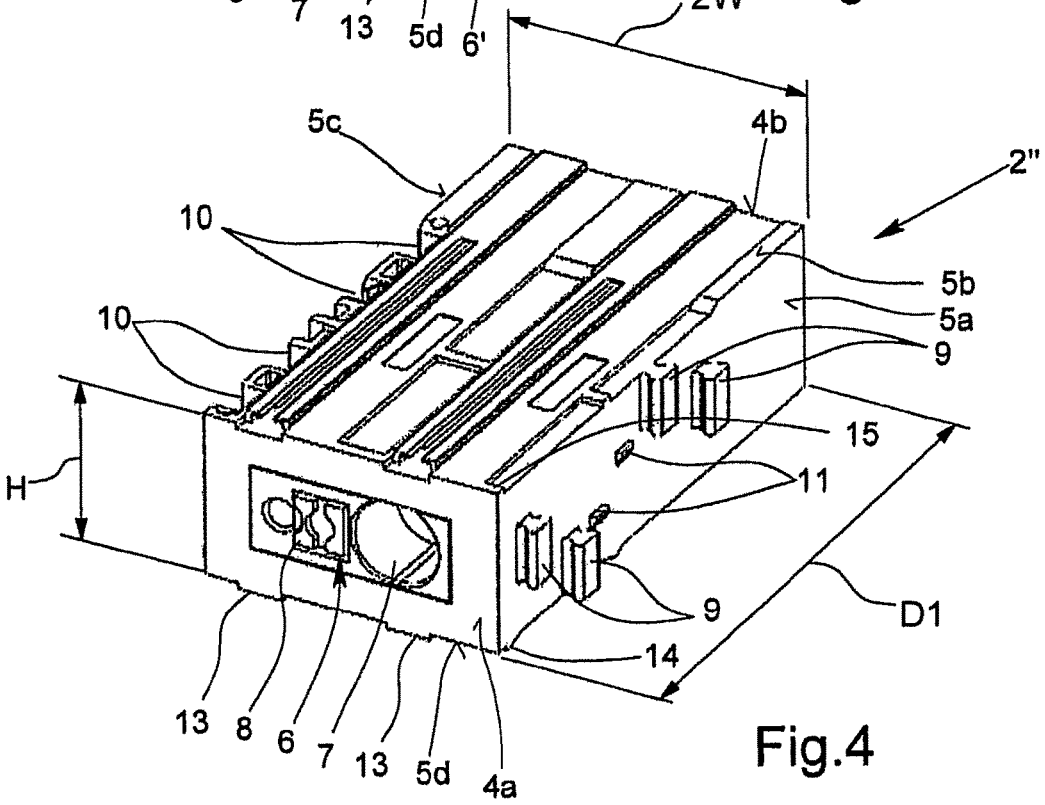
FIG. 4 shows a second embodiment of an individual honeycomb component with a larger cross-section.

FIGS. 3 and 4 show two additional embodiments of a honeycomb component 2', 2", whereby the honeycomb components 2', 2" in comparison to the honeycomb component 2 that is depicted in FIG. 2 have the same height H but both have a double width 2W, so that even the cross-section of the two honeycomb components 2', 2" is twice as large as the cross-section of the honeycomb component 2.

In the honeycomb component 2' that is depicted in FIG. 3, the two front surfaces 4*a*, 4*b* in each case have two connecting areas 6, 6'. In comparison to the honeycomb component 2 according to FIG. 2, the two connecting areas 6, 6' are designed to connect conductors having a larger cross-section, so that the conductor inflow openings 7 also have a larger diameter.

The honeycomb component 2" according to FIG. 4 is provided to connect a conductor to a still larger cross-section, whereby the honeycomb component 2" only has a connecting area 6, which has a correspondingly large conductor inflow opening 7. Arranged in the interior of the housing 3 of the two honeycomb components 2', 2" are in each case corresponding conductor connecting elements—not depicted here—in which are in turn spring-force clamping connections, so that a clamping spring is assigned to each conductor inflow opening 7, which spring clamps a conductor, inserted through the conductor inflow opening 7, against a busbar.

The two honeycomb components 2' and 2" that are depicted in FIGS. 3 and 4 have not only a double width in comparison to the honeycomb component 2 according to FIG. 2, but also a somewhat greater depth D1. The depth D1 of the two honeycomb components 2', 2", however, is—unlike the width—not twice as large as the depth D of the honeycomb component 2 according to FIG. 2. In this case, the depth D1 of the two honeycomb components 2', 2" is approximately 25% greater than the depth D of the honeycomb component 2, noting that this dimension is in no way limiting. It is easily possible that the depth of the two honeycomb components 2', 2" is even greater, or that the two honeycomb components 2' and 2" have different depths.

The two embodiments of the honeycomb components 2', 2" that are depicted in FIGS. 3 and 4 in each case have four arms 9 and two latching catches 11 on their first side surface 5*a*, which catches in their shape and arrangement correspond to the arms 9 or latching catches 11 of the honeycomb component 2 according to FIG. 2. The same also applies for the grooves 10 and latching projections made on the opposite side surface 5*c*, so that the honeycomb component 2 that is depicted in FIG. 2 can be connected in the x-direction not only to another, identical honeycomb component 2 but also to the honeycomb component 2' that is depicted in FIG. 3 or the honeycomb component 2" that is depicted in FIG. 4. Because of the corresponding arrangement and design of the arms 9 and the grooves 10 as well as the latching catches 11 and the latching projections, moreover, the two honeycomb components 2' and 2" that are depicted in FIGS. 3 and 4 can also be directly connected to one another in the x-direction.

On the upper side surface 5*b*, the two honeycomb components 2', 2" have two grooves 12, in which two corresponding arms 13 are made on the lower side surface 5*d*. This first results in that the two honeycomb components 2' and 2" also can be connected to one another in the z-direction, by, for example, the two arms 13 on the lower side surface 5*d* of the honeycomb component 2' being inserted into the two corresponding grooves 12 on the upper side surface 5*b* of the honeycomb component 2". In turn, in this case, latching of the two honeycomb components 2', 2" that are connected to one another is carried out via the latching catches 14 that are made on the lower side surface 5*d* and the latching projections 15 that are made on the upper side surface 5*b*, so that the two honeycomb components 2, 2" cannot be accidentally separated from one another again.

Figure 7:
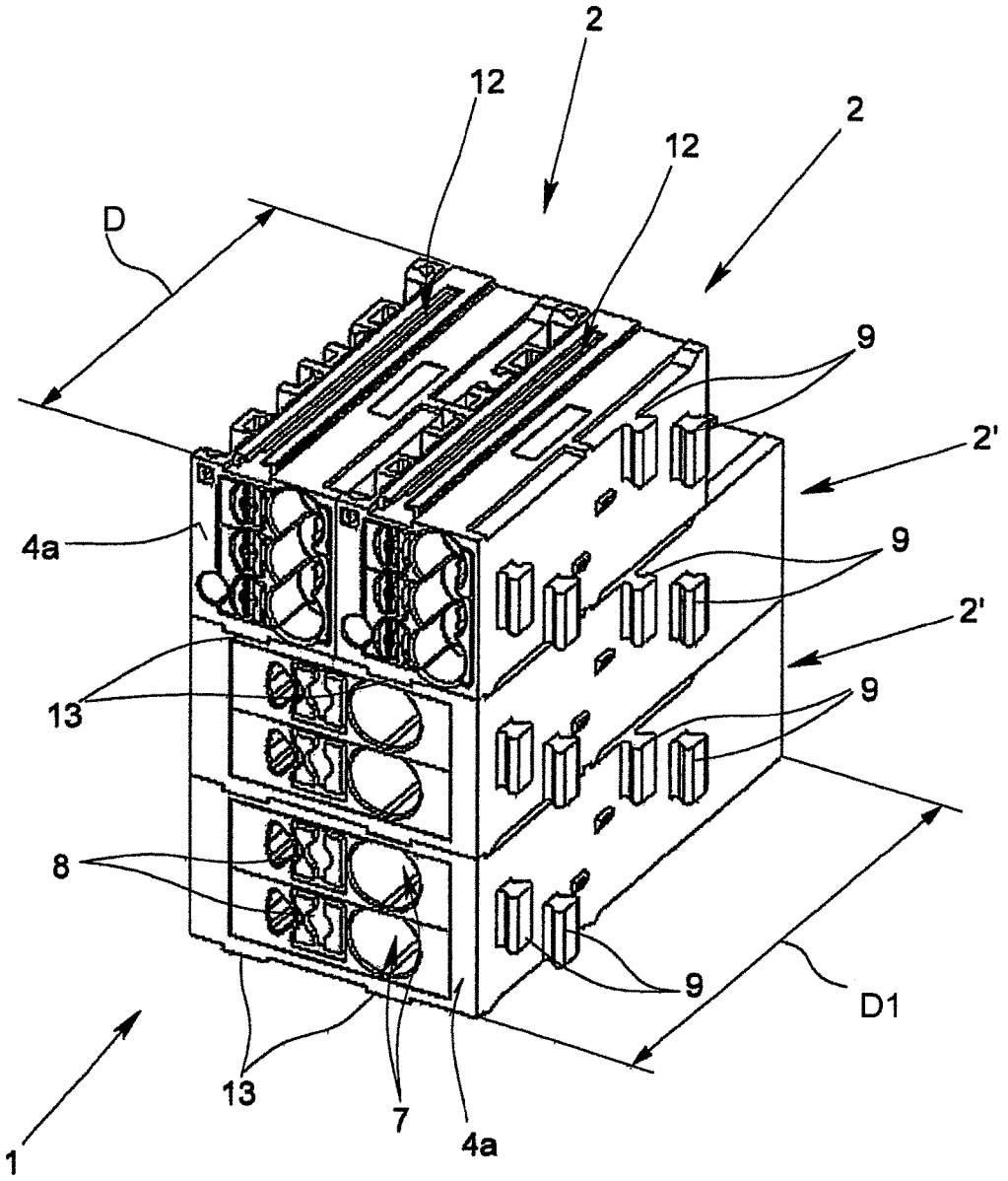
FIG. 7 shows a patchboard, consisting of two honeycomb components according to FIG. 2 and two honeycomb components according to FIG. 3.

As a result of the honeycomb component 2'—just like the honeycomb component 2"—having two grooves 12 on its upper side surface 5*b* and two arms 13 on its lower side surface 5*d*, the honeycomb component 2' can be connected in the z-direction also to two honeycomb components 2 according to FIG. 1, as FIG. 7 shows, for example. The two honeycomb components 2', 2" that are depicted in FIGS. 3 and 4, whose width is twice as great as the width of the honeycomb component 2 that is depicted in FIG. 2, thus also have—on the two double-wide side surfaces 5*b*, 5*d*—a double number of latching elements 12, 13—namely two—in comparison to the honeycomb component 2 according to FIG. 2. A doubling of the number of the latching elements 12, 13 made on the corresponding side surfaces 5*b*, 5*d* is thus also connected to the doubling of the width of the honeycomb component 2', 2", by which it is ensured that a honeycomb component 2 having the width W can also be connected to a honeycomb component 2', 2" having the width 2W.

The above-described multiplication of the number of latching elements of two side surfaces naturally also applies for the case that a honeycomb component has a double height 2H. In this case, a number of latching arms 9 and latching grooves 10 that is double in comparison to the configuration in the honeycomb component 2 according to FIG. 2 would be made on the two side surfaces 5*a*, 5*c*, as well as also on latching catches 11 and corresponding latching recesses. The same principle also applies for honeycomb components whose width and/or height is not only twice the basic width W or the basic height H but rather a whole multiple, for example 3× or 4×. This applies regardless of the concrete configuration of the individual latching elements, as long as the latching elements are designed corresponding to one another. Instead of the arms 9 that are made on the first side surface 5*a*, for example, latching pins could also be provided, whereby then instead of the grooves 10, latching openings corresponding to the latching pins would be made on the opposite, third side surface 5*c*.

Figure 5A:
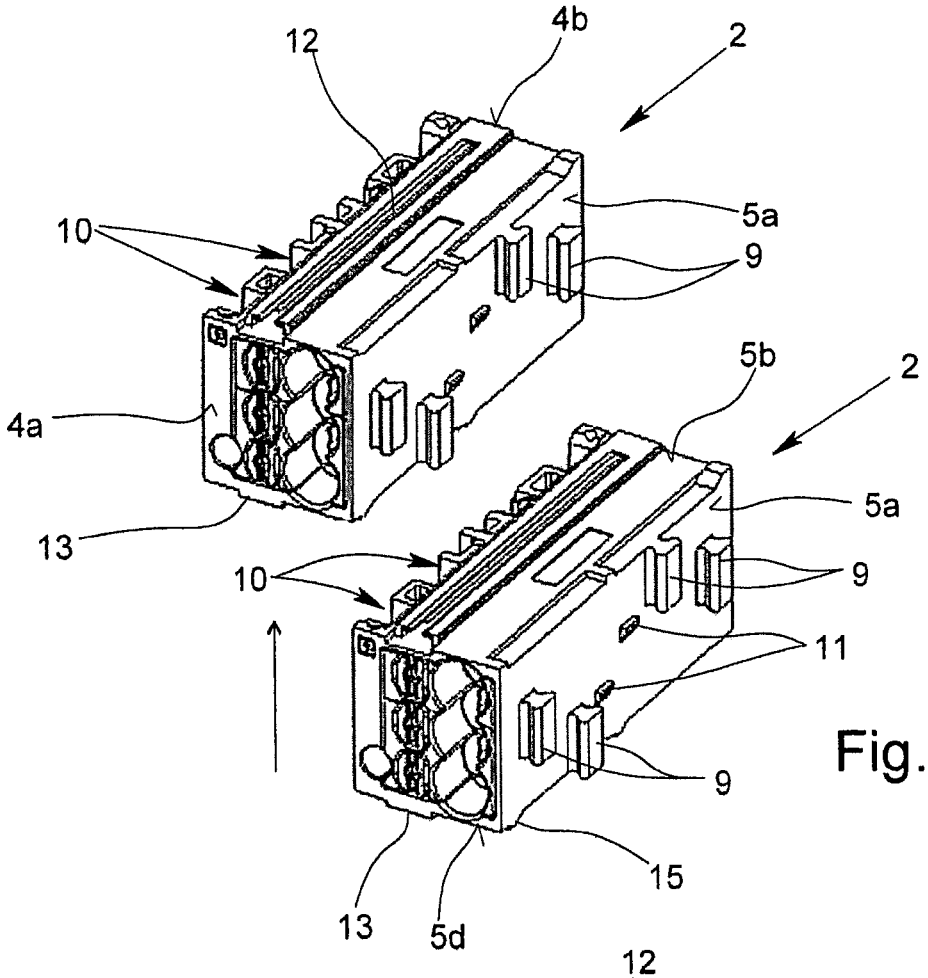
FIGS. 5*a* and 5*b* show two honeycomb components according to FIG. 2 before and after being joined together.
Figure 5B:
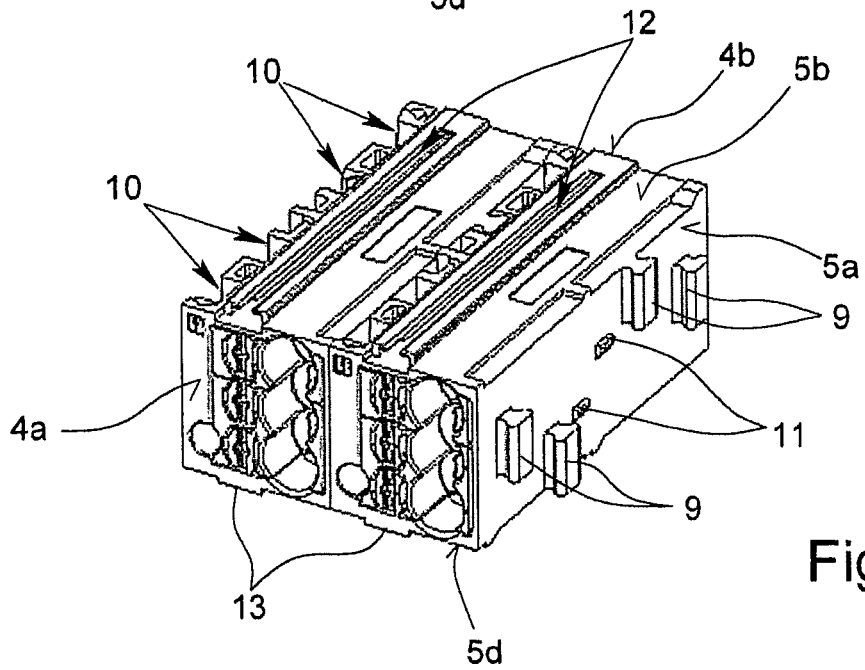

In FIG. 5*a*, two honeycomb components 2 are depicted according to FIG. 2, whereby here, it is shown by the arrow how the two honeycomb components 2 are stuck together when the two honeycomb components 2 are to be arranged beside one another in the x-direction. FIG. 5*b* shows the two honeycomb components 2 after the connecting to one another to form a subassembly that consists of two honeycomb components 2 that are arranged beside one another in the x-direction. The connection of the two honeycomb components 2 in this case is carried out by joining together the arms 9 on the side surface 5*a* of the first honeycomb component 2 with the grooves 10 on the side surface 5*c* of the second honeycomb component 2.

Figure 6A:
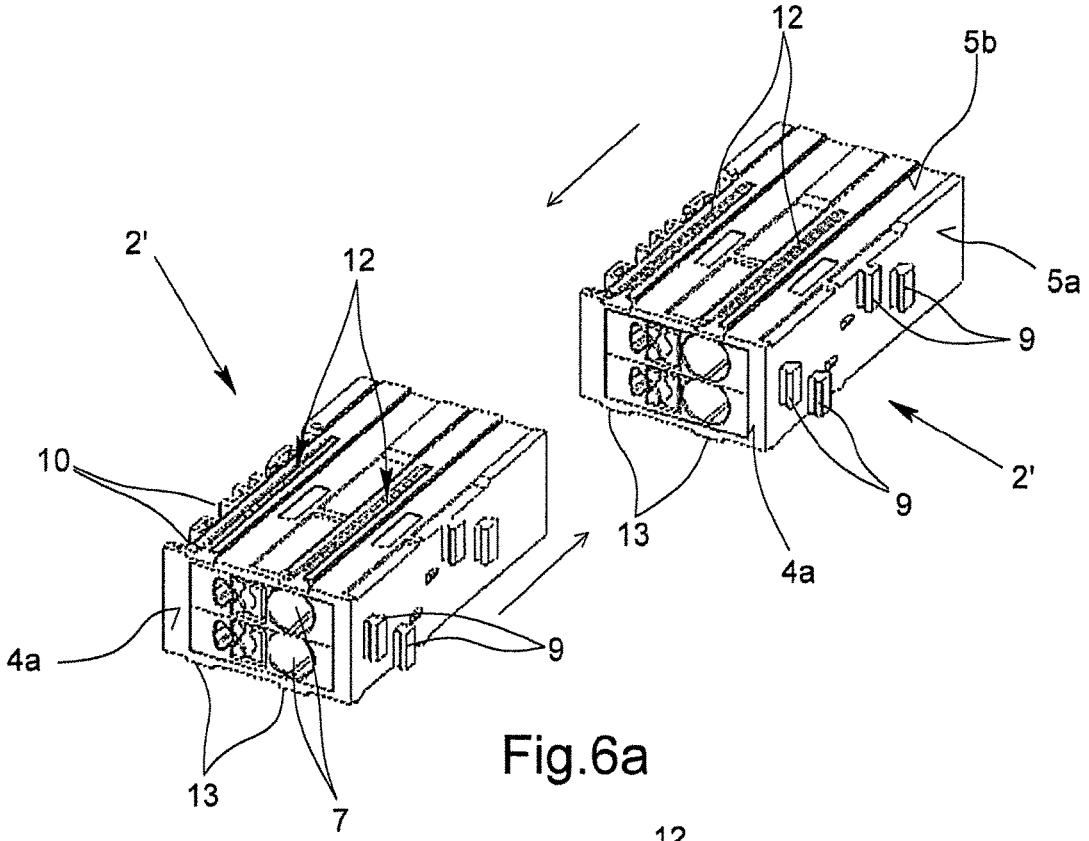
FIGS. 6*a* and 6*b* show two honeycomb components according to FIG. 3 before and after being joined together.
Figure 6B:
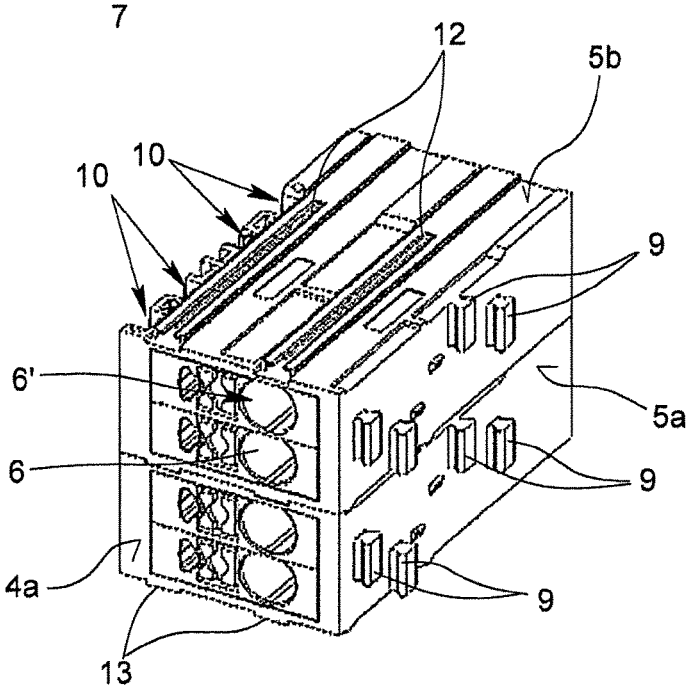

FIGS. 6*a* and 6*b* show two honeycomb components 2' according to FIG. 3 before and after being joined together. Also here, the arrows that are indicated in FIG. 6*a* show how the two honeycomb components 2' are pushed together in order to obtain a subassembly with two honeycomb components 2' that are arranged one above the other in the z-direction according to FIG. 6*b*. Here, the connection is carried out via the arms 13 that are made on the lower side surface 5*d* of the one honeycomb component 2' and the grooves 12 that are made on the upper side surface 5*b* of the other honeycomb component 2'.

In FIG. 7, a patchboard 1 is depicted, which patchboard consists of the two honeycomb components 2 that are depicted in FIG. 5*b* and the two honeycomb components 2' that are depicted in FIG. 6*b*. The two honeycomb components 2 are in this case connected with their arms 13, which are made in each case on the lower side surface 5*d*, to the grooves 12, which are made on the upper side surface 5*b* of the upper honeycomb component 2'. In the mounted state, in this case, the latching catches 14 that are arranged on the lower side surfaces 5*d* of the two honeycomb components 2 engage behind the latching projections 15 that are made on the upper side surface 5*b* of the honeycomb component 2'. Based on the depiction according to FIG. 7, in this case, it is also immediately clear that the two honeycomb components 2' in each case have twice the width of a honeycomb component 2. Moreover, it can be seen that the depth D1 of the honeycomb components 2' is greater than the depth D of the honeycomb components 2.

Figure 8:
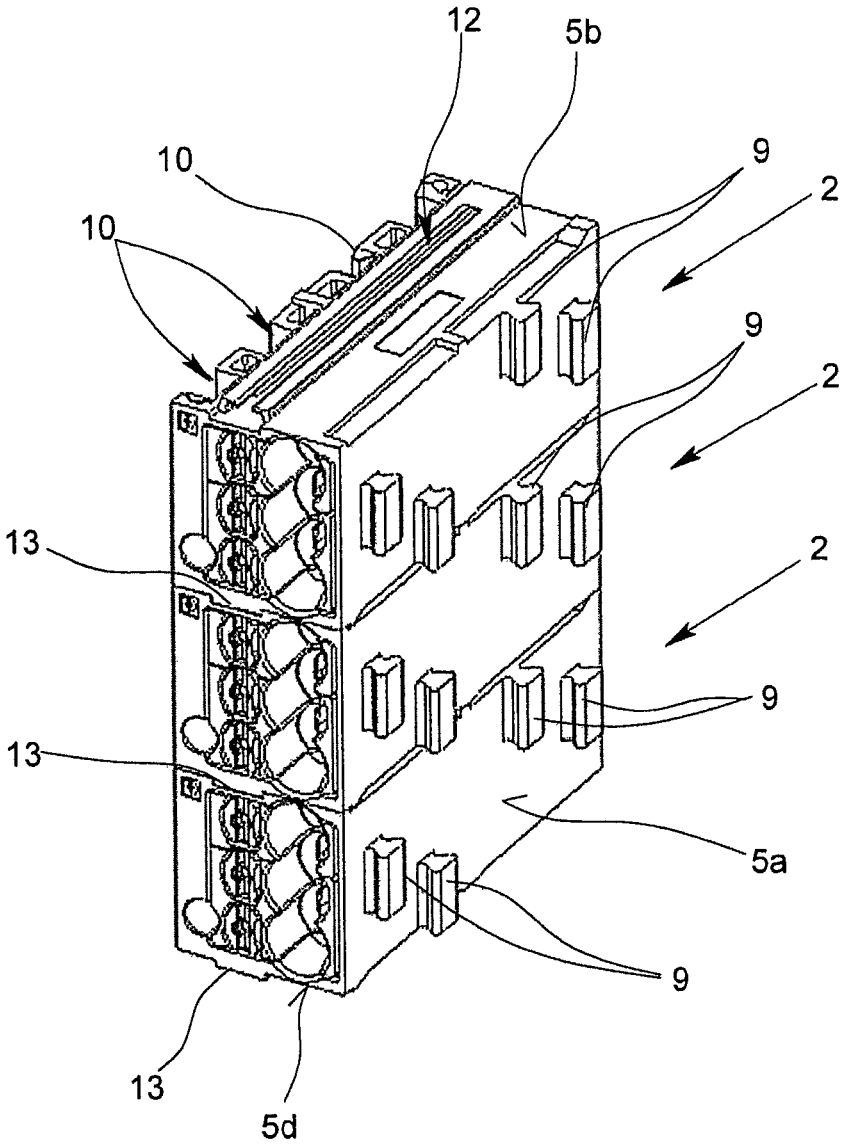
FIG. 8 shows three honeycomb components that are connected together according to FIG. 2.
Figure 9:
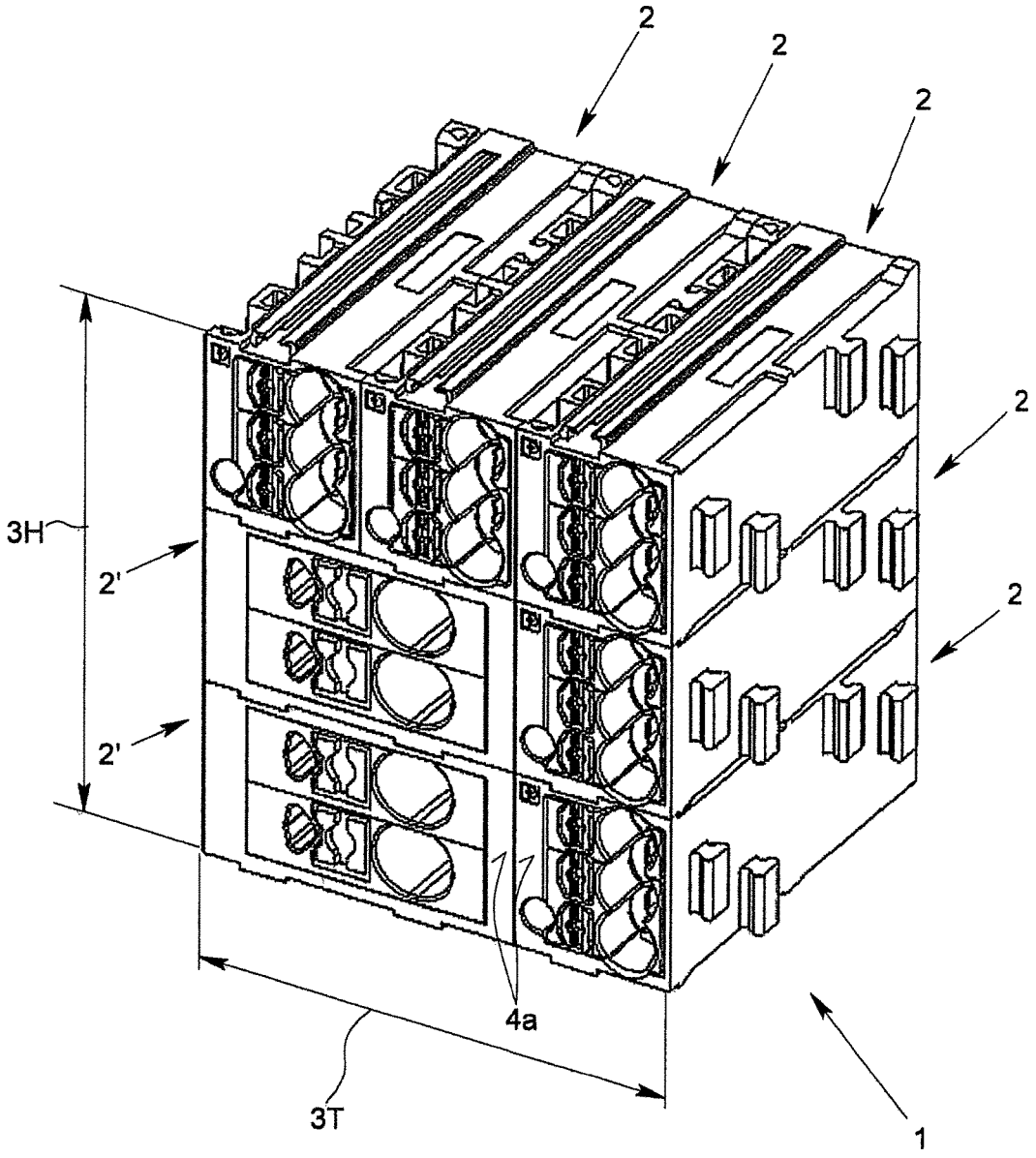
FIG. 9 shows a patchboard, composed of the honeycomb components that are connected to one another and depicted in FIGS. 7 and 8.

In FIG. 8, an arrangement of three honeycomb components 2 according to FIG. 2 is depicted in the z-direction, with the components one above the other. These three honeycomb components 2 that are connected to one another can then be added laterally, for example, to the patchboard 1 that is depicted in FIG. 7, so that the patchboard 1 that is depicted as a whole in FIG. 9 is produced, which consists of five individual patchboards 2 according to FIG. 2 and two patchboards 2' according to FIG. 3. The width and the height of the patchboard 1 that is depicted in FIG. 9 in this case corresponds in each case to the 3× width and the 3× height of a honeycomb component 2 (basic component). It can thus be seen from the depiction in FIGS. 5 to 9 that by the respective addition of other, suitable honeycomb components 2, 2' or 2" in the x-direction and/or in the z-direction, a patchboard 1 can be built up, which patchboard can be easily adapted to the respective requirements. As a result, the size of the patchboard 1 and the number of the connectable conductors can also be easily individually determined and changed if necessary.

In the embodiments that are depicted in FIGS. 2 to 9, the distance from the latching elements of the respective side surfaces 5*a*-5*d* to the first front surface 4*a* in the case of the honeycomb components 2 having a smaller depth D corresponds to the distance from the respective latching elements of the corresponding side surfaces 5*a*-5*d* to the first front surface 4*a* in the case of the honeycomb components 2', 2" having a greater depth D1, so that after multiple honeycomb components 2, 2' are joined together to form a patchboard 1, the first front surfaces 4*a* of the individual honeycomb components 2, 2' all lie in a plane, as can be seen from FIGS. 7 and 9.

Figure 10:
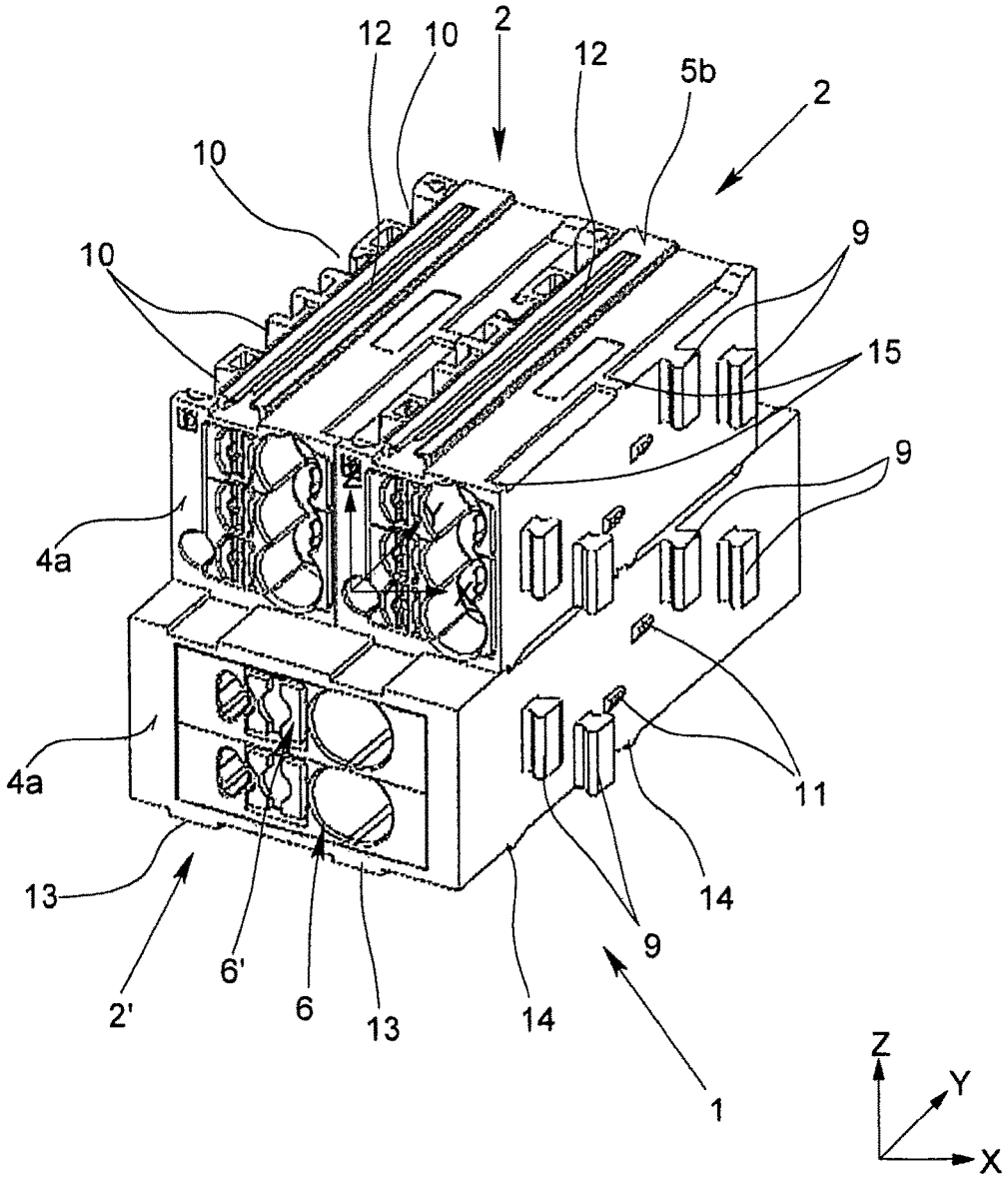
FIG. 10 shows an alternative configuration of a patchboard, consisting of two honeycomb components according to FIG. 2 and a honeycomb component according to FIG. 3.

In contrast to this, an embodiment of two honeycomb components 2 and a honeycomb component 2' is depicted in FIG. 10, in which the latching elements 9 of the respective side surfaces 5*a*-5*b* are arranged symmetrically to the longitudinal extension of the honeycomb components 2, 2'. This has the effect that the two front surfaces 4*a*, 4*b* of the honeycomb component 2 having a smaller depth D in the longitudinal direction, i.e., in the direction of the y-axis, are both the same distance from the front surfaces 4*a*, 4*b* of the honeycomb component 2' having a greater depth D1.

The patchboard 1 that is depicted in FIG. 1 also has—in addition to a number of honeycomb components 2 arranged one above the other in two rows according to FIG. 2 and multiple honeycomb components 2' according to FIG. 3—two honeycomb components 2" according to FIG. 4. Moreover, the patchboard 1 also has multiple honeycomb components 2''', in which the first front surface 4*a* in each case has two connecting areas 6, 6' in the form of a plug-in contact connection. These plug-in contact connections are used for accommodating and for electrical contacting of corresponding plugs 16, which for their part have conductor inflow openings 17 for inserting electrical conductors. From the depiction of the patchboard 1 according to FIG. 1, moreover, it can be seen that depending on the configuration of the connecting areas 6, differently configured plugs 16, 16', 16" can be connected to the respective honeycomb components.

While the honeycomb components 2', 2" and 2''' in each case have only a double width in comparison to the honeycomb components 2, the honeycomb components 2"" have both a double width and a double height in comparison to the honeycomb components 2. In this case, the honeycomb components 2"" have an approximately square connecting area 6 for the connection of corresponding plugs to a corresponding plug configuration. The honeycomb components 2"" have a 4× width in comparison to the honeycomb components 2, whereby the honeycomb components 2"" that are depicted in FIG. 1 are used for connection to corresponding plugs 16''', whose width and height are doubled in each case in comparison to the width and height of the plugs 16'.

It can thus be seen from FIG. 1 that the patchboard 1 can be built up depending on the application and customer preference from a considerable number of different honeycomb components 2, 2', 2", 2''', 2"", 2''''', whereby the individual honeycomb components 2, 2', 2", 2''', 2"", 2''''' can have different dimensions and thus also many connecting areas 6, 6', 6" that are different in size and different in number. Also, the size of the patchboard 1 can also be easily changed, if necessary, by honeycomb components 2 being added, removed, or exchanged.

Finally, it can also be seen from FIG. 1 that the depicted patchboard 1 has multiple terminal elements 18 on two sides, whereby the individual terminal elements 18 are connected to the adjoining honeycomb components via corresponding latching elements. In the depicted embodiment, the individual terminal elements 18 in each case have two grooves 19*a*, 19*b*, which are used to accommodate corresponding marking signs.

What is claimed is:

1. A patchboard with multiple honeycomb components, wherein each of the individual honeycomb components has a box-shaped housing with two front surfaces and four side surfaces, which extend between the front surfaces, and wherein each of the two front surfaces of the honeycomb components has at least one connecting area, wherein:

all of the side surfaces of the honeycomb components each have at least one latching element to connect to another honeycomb component, at least two honeycomb components have different cross-sections, wherein the width and/or the height of a honeycomb component having a larger cross-section is a multiple of the width and/or the height of a honeycomb component having a smaller cross-section, and the number of latching elements of a side surface having a greater width or greater height of a honeycomb component having a larger cross-section is a corresponding multiple of the number of latching elements of a side surface having a smaller width or smaller height of a honeycomb component having a smaller cross-section, wherein the side surfaces of each honeycomb component comprise a pair of oppositely facing lateral side surfaces and oppositely facing top and bottom side surfaces that extend between the lateral side surfaces, wherein the latching elements on the lateral side surfaces are different from the latching elements on the top and bottom side surfaces so that additional blocks are attachable to the top and bottom surfaces by movement in a lengthwise direction of the honeycomb components and additional blocks are attachable to the lateral side surfaces by relative movements in a heightwise direction of the honeycomb components.

2. The patchboard according to claim 1, wherein the honeycomb components having different cross-sections have a different number of connecting areas and/or connecting areas of different sizes.

3. The patchboard according to claim 1, at least two of the honeycomb components have different depths.

4. The patchboard according to claim 3, wherein the distance from the latching elements of the respective side surface to the first front surface in the case of a honeycomb component having a smaller depth corresponds to the distance from the latching elements of the corresponding side surface to the first front surface in the case of a honeycomb component having a greater depth, so that the first front surfaces of the individual honeycomb components all lie in a plane.

5. The patchboard according to claim 3, wherein the latching elements of the respective side surface are arranged symmetrically to the longitudinal extension of a respective honeycomb component, so that both front surfaces of a honeycomb component having a smaller depth in the longitudinal direction have the same distance from the front surfaces of an adjoining honeycomb component having a greater depth.

6. The patchboard according to claim 1, wherein the latching elements of the individual honeycomb components are designed in the form of latching pins, latching openings, arms, grooves, latching catches or latching projections.

7. The patchboard according to claim 1, wherein, in each case, multiple honeycomb components are arranged in two directions of the patchboard that are different from one another, and the components are connected to one another.

8. The patchboard according to claim 1, wherein multiple terminal elements are arranged on at least one side of the patchboard, which elements are connected to the adjacent honeycomb components.

9. A honeycomb component for making a patchboard according to claim 1, with a box-shaped housing, with two front surfaces and four side surfaces, which extend between the front surfaces, whereby the two front surfaces in each case have at least one connecting area and whereby at least two side surfaces in each case have at least one latching element for connecting to another honeycomb component.

* * * * *